US006129601A

United States Patent [19]

Aucoin

[11] Patent Number: 6,129,601

[45] Date of Patent: Oct. 10, 2000

[54] PIVOTABLE SWIM FIN

[76] Inventor: Douglas Matthew Aucoin, 19 Cottage Ave., Pt. Richmond, Calif. 94801

[21] Appl. No.: 09/044,952

[22] Filed: Mar. 19, 1998

[51] Int. Cl.[7] ..... A63B 31/11

[52] U.S. Cl. ..... 441/64

[58] Field of Search ..... 441/61–64

[56] References Cited

U.S. PATENT DOCUMENTS

| | | | |
|---|---|---|---|
| 3,068,488 | 12/1962 | Biskupsky | 441/63 |
| 3,268,927 | 8/1966 | Markowitz | 441/63 |
| 3,411,165 | 11/1968 | Murdoch | 441/64 |
| 5,607,334 | 3/1997 | Garofalo | 441/64 |
| 5,632,662 | 5/1997 | Cadorette | 441/63 |

FOREIGN PATENT DOCUMENTS

| | | | |
|---|---|---|---|
| 40 20 235 | 1/1992 | Germany | 441/64 |

*Primary Examiner*—Sherman Basinger

*Attorney, Agent, or Firm*—Risto A. Rinne, Jr.

[57] ABSTRACT

An apparatus for aid in swimming is described as including a foot receiving portion that is pivotally attached about an axis to a fin portion. A latch mechanism is attached to the fin portion that cooperates with a tapered nose protrusion that is attached to the front of the foot portion. A pair of forward stops are provided in the foot portion which cooperate with a pair of recesses that are formed in the fin portion which together limit the pivotal motion of the fin portion in a first direction until a first position is attained. The tapered nose protrusion cooperates with the latch mechanism in the first position to secure the fin portion in the first position. The latch mechanism includes a release to allow for the manual disengagement of the latch mechanism from the foot portion which, in turn, allows the fin portion to pivot in a second direction that is opposite the first direction until a second position is attained that is disposed approximately opposite the first position. The first position is adapted for swimming and the second position is adapted for walking. A heel strap secures the foot of the user in the foot receiving portion during use.

37 Claims, 4 Drawing Sheets

PIVOTABLE SWIM FIN

BACKGROUND OF THE INVENTION

1. Field of the Invention

The present invention, in general relates to scuba diving and snorkeling equipment and, more particularly, to swim fins which are used to augment locomotion whilst in the water.

Swim fins and their limitation are, in general, known. When a person attempts to walk forward, either in shallow water or on land with swim fins attached to his feet, the flexible fin portion engages the ground and makes forward travel difficult at best and precarious or even dangerous at worst.

As such it is common practice to walk backwards, either on land or in the water, when swim fins are attached to the feet. This too is difficult at best and dangerous at worst. To overcome this problem, swim fins have been developed which include a pivot in which the fin portion can be pivoted from a forward position into a rearward position, better suited for forward walking.

However, certain prior types of pivoting swim fins have proven to be difficult to either secure in the swimming position or to release from the swimming position to allow for pivoting into the walking position. Furthermore, the latching mechanisms of certain prior types of swim fins have tended to accumulate sand and debris making them unreliable or difficult to use.

Also, certain prior types of swim fins require removal of a portion of the swim fin and then reattachment later. This approach is difficult, takes time, and includes some element of risk inherent with such use. Once a portion of the swim is detached from the rest of the swim fin and prior to successful reattachment thereof there is danger that the detached portion of the swim fin can be lost by either sinking or by being carried away by the waves and current. A swim fin that latches automatically would therefore be safer to use in the water.

Certain prior types of pivotable swim fins include a latching mechanism that is prone to accumulate sand, dirt, silt, and other debris as the person walks forward, dragging the fin portion behind his foot. This extraneous material may even be compacted into the latching mechanism, thus rendering it inoperative.

In addition, other prior types of pivotable swim fins do not include a latch that allows for easy positive release and automatic engagement when the fin is pivoted into the normal position for use. Certain of these designs have proven unreliable over time.

Some of the prior types of pivotable swim fins also require extensive modification to the basic well proven construction of a non-pivotable swim fin, thus increasing bulk and stiffness. Excessive stiffness tends to make such pivotable swim fins less efficient in the water. Excessive bulk also tends to make such pivotable swim fins especially heavy and potentially uncomfortable to wear.

Certain other of the prior types of pivotable swim fins are unusual in shape or appearance thereby making their use less desirable because a wearer is subject to detection by others and possible ridicule for wearing an anomalous design.

Also when people, such as rescue personnel, jump from either an airplane or from a helicopter into the water, previous types of swim fins provide excessive wind resistance and drag. They also catch a great deal of water when contact is made, thus increasing the impact experienced by the person jumping into the water. This is true whether the jump is of short distance or from such a height as to require the use of a parachute.

Typically when jumping into the water from an airplane or helicopter, personnel will not even attach the swim fin to their feet, but rather will fasten it adjacent to their shins or calves so as to minimize resistance when jumping and traveling through the air and especially when landing into the water. Then, once in the water, they must remove the swim fin from about their legs and attach it to their feet.

This is difficult, takes time, and includes some element of risk to both the rescue personnel and to the people being rescued (because the time required to accomplish the rescue is accordingly increased). Once detached from the leg of the rescue person and prior to successful attachment to his foot there is danger here also that the swim fin can be lost and either sink or be carried away by the waves and current.

Accordingly there exists today a need for a swim fin that allows for safe and easy walking in a forward direction, that is quickly and safely adapted for use in the water, that does not require removal of any portion, which is pleasing in appearance, and reliable. Clearly, such an apparatus is a useful and desirable device.

2. Description of Prior Art

Pivotable swim fins are, in general, known. For example, the following patents describe various types of these devices:

U.S. Pat. No. 3,315,286 to Brion, Apr. 25, 1967;

U.S. Pat. No. 4,752,259 to Tackett et al, Jun. 21, 1988;

U.S. Pat. No. 4,767,368 to Ciccotelli, Aug. 30, 1988;

U.S. Pat. No. 5,083,954 to Jacobs, Jan. 28, 1992;

U.S. Pat. No. 5,108,327 to Klein, Apr. 28, 1992;

U.S. Pat. No. 5,292,272 to Grim, Mar. 8, 1994;

U.S. Pat. No. 5,447,457 to Kamitani, Sep. 5, 1995;

U.S. Pat. No. 5,632,662 to Cadorette, May 27, 1997; and

U.S. Pat. No. 5,683,279 to Raasch et al, Nov. 4, 1997.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a pivotable swim fin that is pleasing in appearance.

It is also an important object of the invention to provide a pivotable swim fin that is easy to manufacture.

Another object of the invention is to provide a pivotable swim fin that is adapted for use when swimming.

Still another object of the invention is to provide a pivotable swim fin that includes a latching mechanism that permits sand to drain therefrom.

Still yet another object of the invention is to provide a pivotable swim fin that includes a positive forward pivot stop.

Still yet another important object of the invention is to provide a pivotable swim fin that is adapted for use when walking.

Still yet another very important object of the invention is to provide a pivotable swim fin wherein the fin portion can pivot approximately 180 degrees to a second position.

Yet another important object of the invention is to provide a pivotable swim fin wherein the fin portion can pivot an amount that is greater than 180 degrees to a third position.

Another especially important object of the invention is to provide a pivotable swim fin that is adapted to latch automatically in a first, adapted for swimming, position.

Briefly, a pivotable swim fin apparatus that is constructed in accordance with the principles of the present invention has a foot receiving portion pivotally attached about an axis to a fin portion. The fin portion is adapted to pivot with respect to the foot portion from a first forward horizontal position adapted for swimming into a second rearward horizontal position adapted for walking. The fin portion includes a pair of recesses formed in the sides thereof proximate the axis which cooperate with a pair of forward stops provided in the foot portion on opposite sides thereof. The foot portion includes a tapered nose protrusion which cooperates with a latch mechanism that is attached to the fin portion. The latch mechanism includes at least one drain hole which permits sand and debris to drain therefrom thus helping to keep the latch mechanism operative.

DETAILED DESCRIPTION OF THE INVENTION

Figure 1:
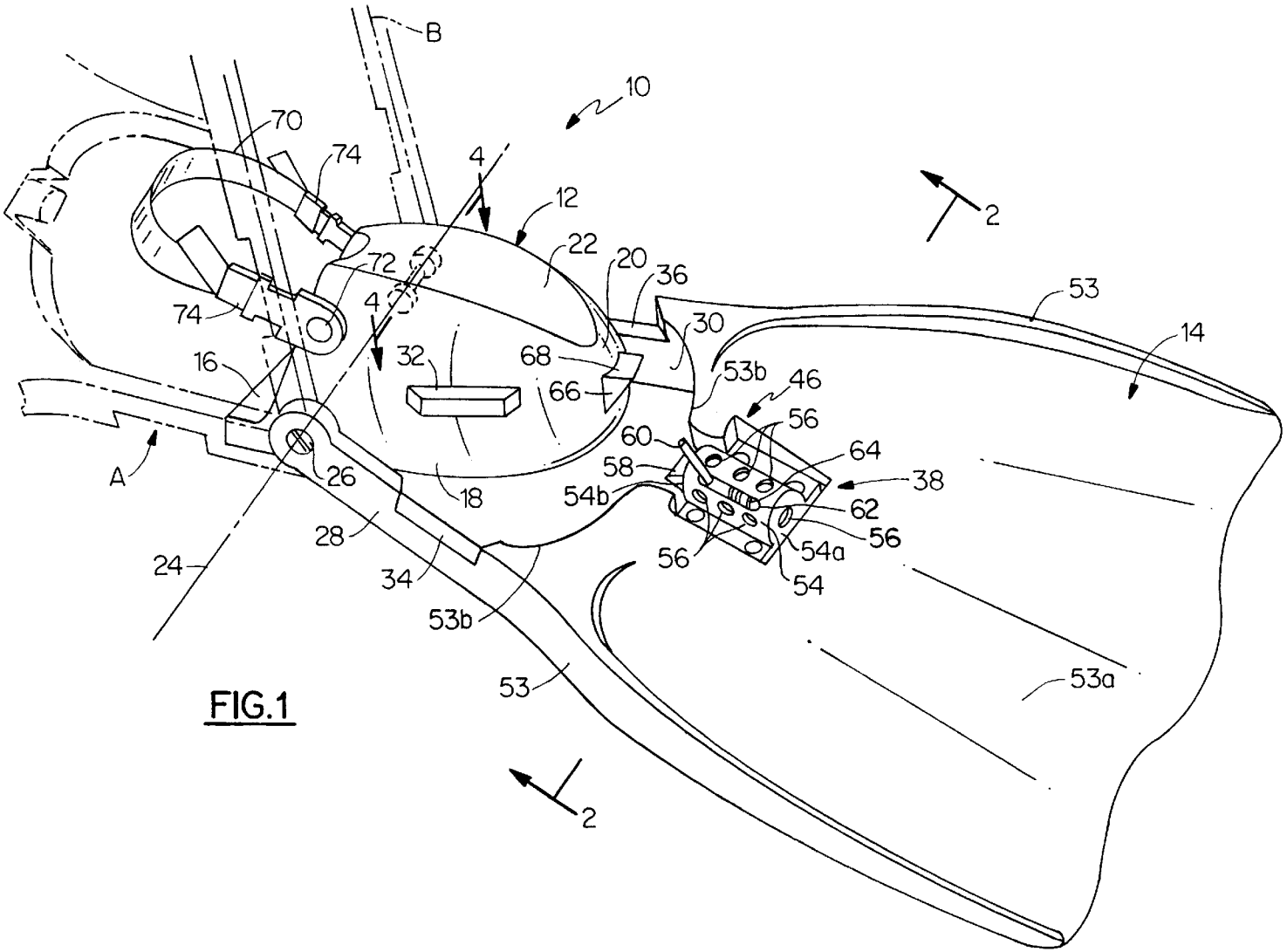
FIG. 1 is a view in perspective of a pivotable swim fin shown proximate a first position, adapted for use while swimming and partially shown in dashed lines in a second position, adapted for use while walking and again in dashed lines in a third position adapted for use when jumping into the water.

Referring to FIG. 1 is shown, a pivotal swim fin, identified in general by the reference numeral 10. The fin 10 includes a foot receiving portion and an attached fin portion, each shown in general by the reference numerals 12 and 14, respectively.

The foot portion 12 is an enclosure having a bottom 16, a first side 18 attached to the bottom 16, a second side (reference numeral 19 of FIG. 4) that is disposed on the opposite side of the bottom and is also attached to the bottom 16, a front portion 20 that is attached to one end of each of the first and second sides 18, 19 and the bottom 16, and a top portion 22 that is attached to the first and second sides 18, 19 opposite where the bottom 16 is attached thereto. The top portion 22 is attached to the front portion 20, also at an opposite end as compared to where the bottom 16 is attached thereto.

The fin portion 14 is shown slightly below a first position, as is described in greater detail hereinafter, in which the fin 10 is adapted for use while swimming. It is also partially shown in dashed lines in a second position adapted for walking, identified in general by the reference letter "A" and is also partially shown in dashed lines in a third position, identified in general by the reference letter "B". The fin portion 14 is shown slightly below the first position to better reveal details of construction as are described in greater detail hereinafter.

Figure 4:
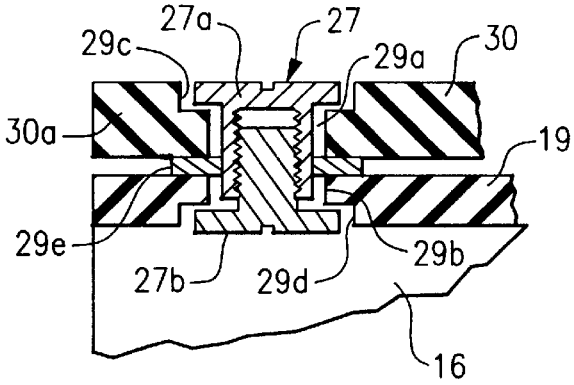
FIG. 4 is a cross sectional view taken on the line 4—4 in FIG. 1.

The fin portion 14 is pivotally attached to the foot portion 12 about a horizontal axis 24 which passes through a first fastener 26 and through a second fastener (identified in general by reference numeral 27 of FIG. 4). The first fastener 26 passes through a first aperture (not shown) that is provided in a first end of a first arm 28 of the fin portion 14 and through a second aperture (not shown) that is provided in the first side 18. The first fastener 26 retains the first arm 28 in a position of cooperation with the first side 18 and permits it to pivot about the horizontal axis 24.

The first fastener 26 and the second fastener 27, though identical in construction, are each disposed opposite one another on the first side 18 and on the second side 19, respectively, of the foot portion 12. Referring momentarily now to FIG. 4, detail as to the preferred construction and assembly of the second fastener 27 is shown which applies equally as well to that of the first fastener 26.

The second fastener 27 passes through a third aperture 29*a* provided in a first end 30*a* of a second arm 30 of the fin portion 14 and also through a fourth aperture 29*b* provided in the second side 19. The third aperture 29*a* includes a first enlarged portion 29*c* and the fourth aperture 29*b* includes a second enlarged portion 29*d*.

The second fastener 27 includes an outer bolt 27*a* and an inner bolt 27*a*. The outer bolt 27*a* has an enlarged bolt head and female threads. The inner bolt 27*b* also has an enlarged bolt head and includes male threads which cooperate with the female threads of the outer bolt 27*a*. The enlarged bolt head of the outer bolt 27*a* fits within the first enlarged portion 29*c* so that it is flush with the surface of the second arm 30. Having the outer bolt 27*a* flush with the surface significantly improves the appearance of the fin 10.

The enlarged bolt head of the inner bolt 27*b* fits within the second enlarged portion 29*d* so that it too is flush with the surface of the second side 19 that is on the inside of the foot portion 12. This prevents the enlarged bolt head of the inner bolt portion 29*b* from contacting a foot (not shown) that is placed inside the foot portion 12 during use.

A washer 29*e* is disposed intermediate the second side 19 and the second arm 30. The washer 29*e* provides separation between the second side 19 and the second arm 30 which reduces friction between these parts which, in turn, allows for the fin portion 14 to pivot with greater ease with respect to the foot portion 12 about the horizontal axis 24. Accordingly, the second fastener 27 retains the second arm 30 in a position of cooperation with the second side and permits it to pivot freely about the horizontal axis 24. The first fastener 26 accomplishes the same with regard to the first arm 18 and the first side 18.

Referring again primarily to FIG. 1, to effectively use the fin 10 to assist with forward locomotion when the user is in the water the fin portion 14 must be raised generally in an upward direction with respect to the foot portion 12 as compared to that shown in the FIG. 1 drawing.

The upward pivotal motion of the fin portion 14 is limited by a first forward stop 32 that is attached to the first side 18 of the foot portion 12 and by a second forward stop (not shown) that is attached to the second side of the foot portion.

The word "attached" is intended to also include methods of manufacture that incorporate the first and the second forward stops 32 as an integral part of the foot portion 12, including having these parts contained in the basic mold (form) by which the foot portion 12 is formed. They may also be attached afterwards as separate component parts by the use of an adhesive or by fasteners, if desired.

A first recess 34 is provided in the first arm 28 proximate the first end thereof having a configuration adapted to cooperate with that of the first forward stop 32 when the fin portion 14 is pivoted in an upward direction with respect to the foot portion 12 in such a manner so as to prevent further rotation from occurring. A second recess 36 is provided in the second arm 30 proximate the first end thereof that similarly cooperates with the second forward stop to prevent further forward rotation.

Preferably, the first and second forward stops 32 are each constructed so as to have dimensions only slightly less than that of first and second recesses 34, 36 and to be of similar color and texture material. Therefore, when the fin portion 14 is in the first position, the first and second arms 28, 30 together with the first and second forward stops 32 have the appearance of being contiguous. This helps the fin 10 to look more conventional in appearance.

When the fin portion 14 is pivoted upward until the first and second forward stops 32 are in contact with the first and second recesses 34, 36, the fin 10 is in the first position adapted for swimming.

Figure 2:
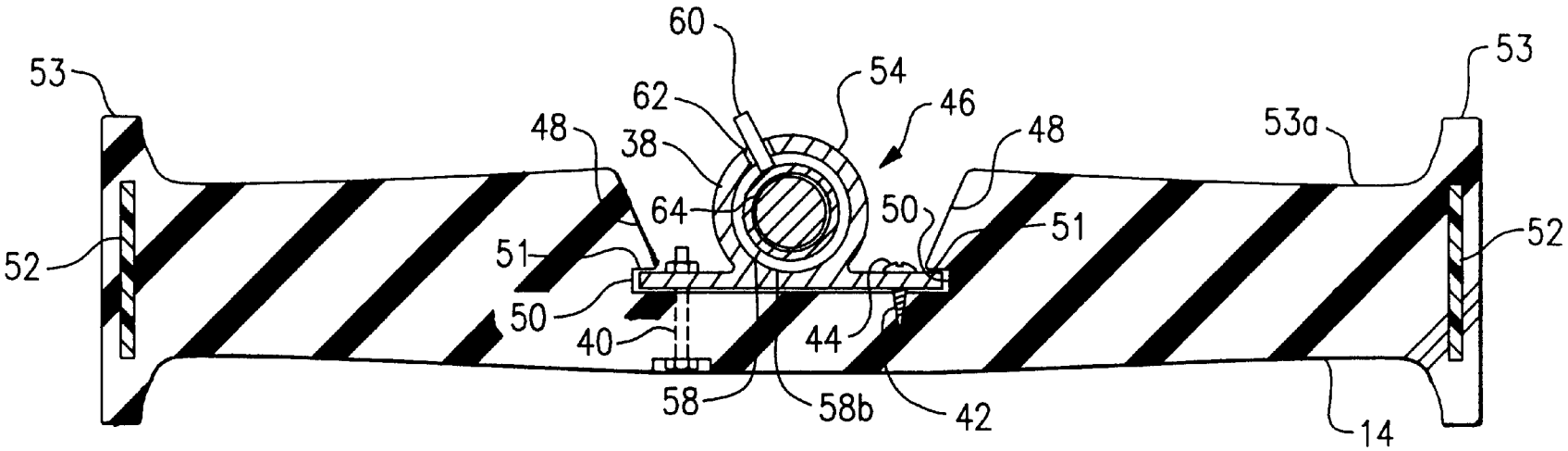
FIG. 2 is a cross sectional view taken on the line 2—2 as shown in FIG. 1.
Figure 3:
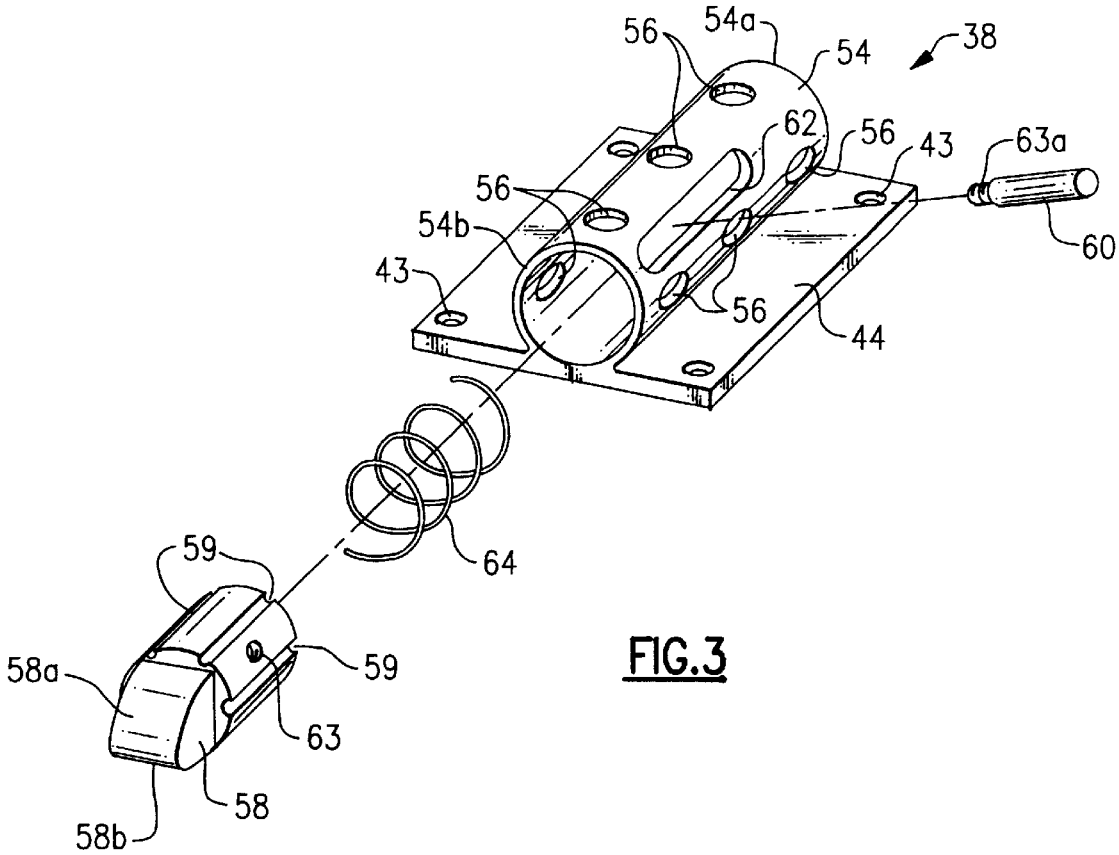
FIG. 3 is an exploded view of the latch mechanism of FIG. 1.

Referring on occasion to FIG. 2 and FIG. 3, the fin portion 14 is secured in the first position by a latch mechanism, identified in general by the reference numeral 38, that is attached to the fin portion 14. A bolt 40 and a screw 42 are shown as two alternative types of fasteners which may be used. The bolt 40 and the screw 42 each pass through one of a plurality of base holes 43 that are provided through a base plate 44.

The base plate 44 is attached to the latch mechanism 38 at the bottom thereof. Alternatively, the latch mechanism is retained in position by cooperation with a recessed area that is provided in the fin portion 14, the recessed area being identified in general by the reference numeral 46.

The recessed area 46 includes opposite tapered sides 48 which are disposed further apart at the top and closer together at the bottom and which include an indented portion 50 at the bottom thereof. The base plate 44 may, alternatively, be pressed into the recessed area 46 until it reaches the indented portion 50 which then secures the latch mechanism 38 in position, as is described hereinafter.

The tapered sides 48 facilitate the insertion of the base plate 44 and may be disposed around the entire periphery of the recessed area 46. The indented portion 50, if desired, may also be disposed around the entire periphery. Accordingly, it is possible to secure the latch mechanism 38 in position merely through cooperation with the indented portion 50, once the base plate 44 is first pressed into position.

The indented portion 50 includes an upper lip 51 which provides a surface that tends to cover and therefore secure the base plate 44 in position after it is forcibly pressed into the bottom of the recessed area 46. The material which the fin portion 14 is constructed must exhibit at least some degree of flex if it is to operate optimally as a swim fin 10, and accordingly, it will exhibit some degree of resiliency and elasticity.

This property (resiliency and elasticity) in addition to making the swim fin 10 more efficient in water, is also utilized to compress the tapered sides 48 and the upper lip 51 a sufficient amount so as to permit the base plate 44 to be lowered into position until it reaches the bottom of the recessed area 46.

Once at the bottom, the outer edges of the base plate 44 enter into the indented portion 50 of the recessed area 46. The resiliency of the material that is used to form the fin portion 14 then urges the upper lip 51 and the remaining bottom portions of the tapered sides 48 outward to extend over the base plate 44, thus securing it in position.

Any suitable material may be used to form the fin portion 14 including, but not limited to, rubber, plastic, various elastomers, composite materials, and the like. If preferred, more rigid materials may be used for added strength where desired. For example, the first and second arms 28, 30 may contain an inner reinforcing member (reference numeral 52, FIG. 2) to increase strength or stiffness. The inner reinforcing member 52 may be either the same, more, or less flexible than the rest of the fin portion 14 fin 10.

The first and second arms 28, 30 each include a second end that is opposite the first end and which is attached to the remainder of the fin portion 14. If desired, the first and second arms 28, 30 may contain the reinforcing member 52, as was described hereinabove, disposed within a pair of outer sides 53 which are generally in planar alignment with respect to each other but are each disposed on opposite sides of the fin portion 14. The reinforcing members 52 may traverse a portion of the length of the outer sides 53 or they may traverse the entire length thereof.

The outer sides 53 are tapered, as is in general the entire fin portion 14, with each being of maximum thickness at the end that is proximate the foot portion 12 and of minimum thickness at the end that is disposed furthest away from the foot portion 12. Disposed intermediate the outer sides 53 is a web **53*a* that is also tapered, and is generally of a lesser thickness than are the outer sides 53**.

The web **53*a* includes an arcuate segment 53*b* that is disposed proximate the foot portion 12 and intermediate the first and second arms 28, 30. The arcuate segment 53*b* generally corresponds with the contour of the front portion 20. When the swim fin 10 is in the first position, the arcuate segment 53*b*, in cooperation with the front portion 20, gives the appearance of being contiguous with the foot portion 14. This also tends to make the swim fin 10** appear more conventional in appearance.

The entire swim fin 10 and in particular, the outer sides 53 and the web **53*a*** are anticipated to incorporate, as desired, variations of flexibility, shape, size, and contour so as to take advantage of all improvements as may be (or become) known to conventional types of swim fins (not shown).

The latch mechanism 38 includes a hollow, generally cylindrical portion 54 which has a forward end **54*a* that is substantially closed and a rear end 54*b* disposed opposite with respect to the forward end 54*a*. The rear end 54*b* includes an opening into the cylindrical portion 54**.

A plurality of drain holes 56 are provided in the cylindrical portion 54. The drain holes 56 each function as a drain which allow sand, dirt, and other types of debris (not shown) to exit therefrom. The forward end **54*a* may also include one or more of the drain holes 56, if desired. The drain holes 56 encourage the flow of water therein, which helps to cleanse debris out from the remainder of the latch mechanism 38**.

A tapered catch 58 includes an arcuate upper end **58*a* that protrudes out from the rear end 54*b* of the cylindrical portion 54 and an opposite flat end 58*b* that is disposed generally at the bottom of the latch mechanism 38. The tapered catch 58 is substantially contained within the cylindrical portion 54 and is adapted to slide longitudinally within the cylindrical portion 54**.

A plurality of grooves 59 are provided, as desired, along the longitudinal length of the body of the tapered catch 58. The grooves 59 also allow for sand, dirt, and debris to exit from the latch mechanism 38 as well as encourage the flow of water therein, which serves to cleanse the remainder of the latch mechanism 38.

Together the drain holes 56 and the grooves 59 provide an efficient self-cleaning latch mechanism 38 that is adapted for use in what is a relatively severe environment full of contaminants which might otherwise impede the functioning of the latch mechanism 38.

The tapered catch 58 is prevented from completely exiting from the cylindrical portion 54 by a pin 60. The pin 60 passes through an open slot 62 that is provided in the cylindrical portion 54 and which is disposed longitudinally along the cylindrical portion 54. The pin 60 is attached to the tapered catch 58 and, accordingly, the tapered catch 58 is prevented from exiting from the cylindrical portion 54 when the pin 60 makes contact with the end of the open slot 62 that is nearest the rear end 54*b* of the cylindrical portion 54.

Referring momentarily to FIG. 3, the tapered catch 58 includes a hole 63 having internal female threads. The pin 60 includes exterior male threads 63*a* which cooperate with female threads of the hole to secure the pin 60 to the tapered catch 58. The pin 60 may, of course, be press fit into the hole 63, if desired.

A coil spring 64 is disposed in the cylindrical portion 54 intermediate the tapered catch 58 and the forward end 54*a*. The spring 64 is sufficiently large enough so that it cannot exit through the drain hole 56 that is disposed in the forward end 54*a*. The spring 64 applies a force which urges the tapered portion in a direction generally toward the foot portion 12 of the fin 10.

As mentioned above, the pin 60 makes contact with the end of the open slot 62 which limits the longitudinal range of motion of the tapered catch 58 in this direction (toward the foot portion 12). When the pin 60 is urged by a user (not shown) in a direction generally away from the foot portion 12 of the fin, the pin 60 eventually makes contact with the remaining end of the open slot 62 which limits the range of motion of the tapered catch 58 in this direction (away from the foot portion 12), as well.

The front portion 20 of the foot portion 12 includes a tapered nose protrusion 66 attached thereto that includes a lower portion that is disposed adjacent to the front portion 20 and an upper portion that is disposed away from the front portion 20 with a tapered surface disposed intermediate thereto. The top of the nose protrusion 66 includes a flat area 68.

When the fin portion 14 is pivoted upward with respect to the foot portion 12, the arcuate upper end 58*a* of the tapered catch 58 makes contact with the tapered surface of the nose protrusion 66 which gradually pushes the tapered catch 58 further into the cylindrical portion 54 until the opposite flat end 58*b* of the tapered catch 58 is disposed somewhat above the flat area 68 of the nose protrusion 66. Once the flat end 58*b* of the tapered catch 58 has risen past the flat area 68 of the nose protrusion 66, the coil spring 64 then urges the tapered catch 58 further out of the cylindrical portion 54 toward the foot portion 12 so that the opposite flat end 58*b* is disposed adjacent to the flat area 68 of the nose protrusion 66.

The latch mechanism 38 allows the fin portion 14 to pivot "up" into the first position, and once there it prevents the fin portion 14 from pivoting "down". The first and second forward stops 32 limit the upward motion of the fin portion 14 while the latch mechanism 38 prevents the fin portion 14 from pivoting in the opposite direction. Thus, the fin portion 14 is maintained in the first position and, accordingly, is well adapted for swimming.

In actual use, the above latching of the fin portion 14 in the first position happens when the user begins to swim and to kick normally. The fin portion 14 naturally trails behind the user which brings it close to the first position. Typically, the first downward kick by each foot of the user is sufficient to first deflect the fin portion 14 into the first position. It has already been described hereinabove how the latch mechanism 38 automatically secures the fin portion 14 in the first position. The self-cleaning attributes of the latch mechanism 38 improve the reliability of the latch mechanism 38.

The entire latch mechanism 38, as well as any selected component part thereof, may be made from whatever material is preferred. Certain corrosion resistant materials such as aluminum or stainless steel are preferred as are composite materials including graphite or various hardened types of plastics. Lessening the weight of the fin 10 is a design factor that is preferred.

While the latch mechanism 38 may be of any color, it is anticipated that it will be the same color as the bulk of the fin portion 14 if it is desired to maintain a conventional appearance or of a contrasting color if it is desired to highlight the novelty of its design, each in accordance with prevailing consumer preferences.

The foot of the user is inserted into the foot portion 12 of the swim fin 10 and is held in place by a detachable adjustable heel strap 70. The heel strap 70 is pivotally attached at one end thereof to the foot portion 12 at a first pivot point 72 that is disposed on the first side 18 and is pivotally attached at the remaining end thereof to a second pivot point (not shown) that is disposed on the second side. The length of the heel strap 70 is adjustable as is well known in the arts to accommodate different sizes of feet. A pair of connectors 74 allow for rapid detaching of a portion of the heel strap 70 apart from that portion that is attached to the first and second pivot points 72.

To release the fin portion 14 from the first position, the user pushes the pin 60 in a forward direction (generally away from the foot portion 12) which retracts the tapered catch 58 into the cylindrical portion 54 a sufficient amount to allow for the tapered catch 58 to clear the nose protrusion 66. This allows the fin portion 14 to pivot generally in a downward direction away from the foot portion 12.

When the swim fin 10 is attached about the foot of the user and the latch mechanism 38 is released, as was described in the preceding paragraph, the user simply raised his feet somewhat more than usual as he walks in a forward direction. This facilitates the complete pivoting of the fin portion 14 approximately 180 degrees to the rear, as is partially shown in dashed lines in FIG. 1.

The fin portion 14 then trails behind the foot of the user as he walks in a forward direction. The fin portion 14 is free to pivot so that, as the user raises each foot when he walks forward, the fin portion 14 is free to pivot slightly and basically drag behind the user. This is desirable because it prevents the user from having to lift the weight of the fin portion 14 with each step.

A potential disadvantage is that the latch mechanism 38, dragging on the surface, may accumulate dirt and debris. It has already been explained how the drain holes 56 and the grooves 59 augment the self-cleaning ability of the latch mechanism 38. Yet another design attribute helps in this regard. The outer sides 53, being thicker than the web 53*a*, function as "skids" and so elevate the latch mechanism 38 above the surface, thus minimizing contact the latch mechanism 38 may have with the surface and, accordingly, the opportunity for the latch mechanism 38 to accumulate dirt and debris.

Also, the recessed area 46, is ideally formed to be approximately as deep as is the overall thickness of the latch mechanism 38. Similarly, the tapered sides 48 are preferably disposed as close as possible to each side of the cylindrical portion 54 and, together with the depth of the recessed area, form a protective enclosure which effectively houses the latch mechanism 38.

The recessed area also includes an opening, identified in general by the reference numeral 76, that is disposed in the web 53*a* proximate the foot portion 12. The opening 76 is provided so that the tapered catch 58 can extend beyond the fin portion 14 and actually make contact with and engage, the nose protrusion 66 as was described hereinabove.

Referring again primarily to FIG. 1, the fin 10 is partially shown in dashed lines in the third position B. The third position B is attained by a further pivoting of the fin in the same direction as when pivoting from the first position into the second position A. From the second position A the fin 10 is pivoted upward to reach the third position B.

The third position B is useful for jumping into the water. The user merely pivots the fin 10 into the second position A and then jumps into the water. It is not necessary for the fin portion 14 to pivot into a vertical orientation with respect to the foot portion 12. The preferred attitude of the fin portion 14 with respect to the foot receiving portion 12 in the third position B requires that the fin portion 14 pivot approximately 225 degrees from the first position.

In use, the user merely points his foot down as much as possible during the jump and the ever increasing wind resistance (resulting from an increase in velocity during the jump) continues to pivot the fin 10 upward as much as possible. The result is that the fin portion 14 attends close to a calf of the leg (not shown in FIGS. 1–4) of the user which greatly reduces wind resistance and impact upon entering into the water.

To improve the operation of the fin 10 in the third position B, the horizontal axis 24 is extended to the rear so that it is very nearly under a heel (not shown in FIGS. 1–4) of the user. This prevents interference between the arcuate segment 53*b* and the heel of the user when the fin portion 14 is pivoted into the third position B. For example, as shown in FIG. 1, the fin portion 14 can not be pivoted into a vertical position (270 degrees of rotation) while the user's foot is in the foot receiving portion because the fin portion 14 would bear uncomfortably against the calf of the user's leg.

Figure 6:
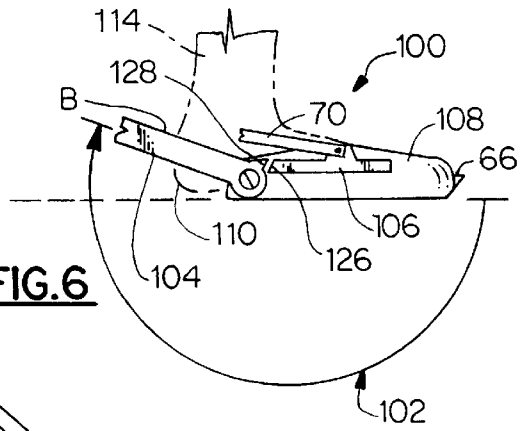
FIG. 6 is a side view of a portion of the modified pivotable swim fin of FIG. 5 shown in the third position.
Figure 5:
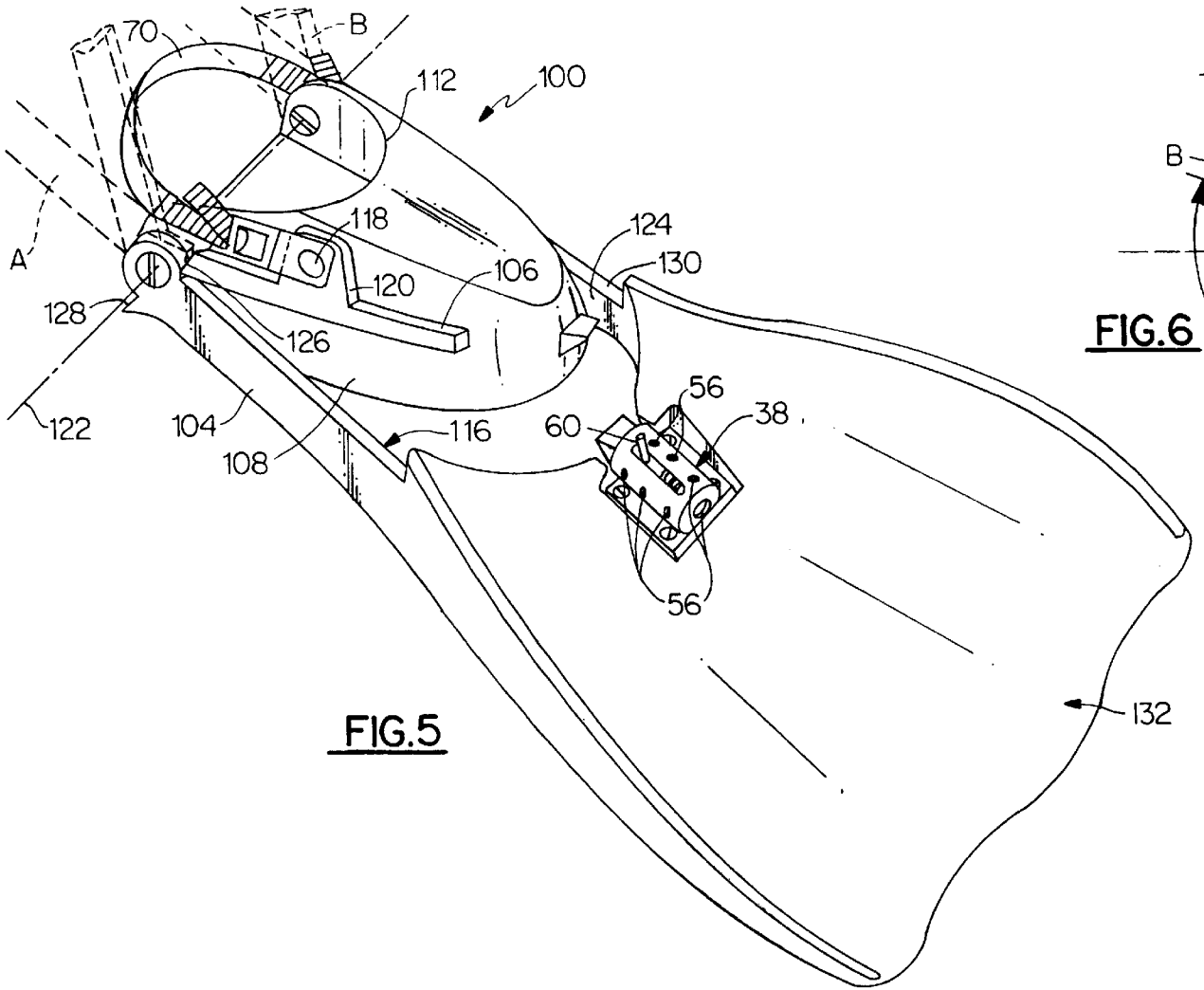
FIG. 5 is a view in perspective of a modified pivotable swim fin shown proximate a first position, adapted for use while swimming and partially shown in dashed lines in a second position, adapted for use while walking and again in dashed lines in a third position adapted for use when jumping into the water.

Certain modifications to the fin 10 enhance its use in the third position B and are shown in FIGS. 5 and 6, which reveal a modified pivotable swim fin, identified in general by the reference numeral 100. Identical component parts utilize the same reference numbers as previously described.

FIG. 6 shows a portion of the modified fin 100 in the third position B. An arc 102 reveals both the direction and magnitude that a modified first arm 104 has pivoted from the first position in order to attain the third position B. The preferred magnitude is 225 degrees of rotation from the first position.

A modified first forward stop 106 is longer than the previously described first forward stop 32 and is attached to a modified foot receiving portion 108. The modified foot receiving portion 108 is also lengthened to accommodate an entire foot 110 of a user. A second arcuate segment 112 is removed from the top and opposite sides of the modified foot portion 108 to allow for a leg 114 to extend therefrom.

The modified first forward stop 106 cooperates with a modified first recess 116 disposed in the modified first arm 104, the modified first recess 116 being similarly lengthened as is the modified first forward stop 106.

The heel strap 70 is pivotally attached at one end thereof to the modified foot portion 108 at a modified first pivot point 118. The modified first pivot point 118 is attached to an extension 120 of the modified first forward stop 106, the extension 120 being disposed intermediate the longitudinal length of the modified first forward stop 106.

It is necessary to move the modified first pivot point 118 forward, as compared to the first pivot point 72, in order to supply tension to the back of the foot 110 because the foot 110 is disposed further within the modified foot receiving portion 108 as compared with the previously described foot receiving portion 12.

A modified axis 122, about which the modified first arm 104 and a modified second arm 124 pivot, is disposed as far as possible to the rear of the modified foot portion 108. Having the modified axis 122 disposed as far as possible to the rear allows for unfettered pivotal motion of the modified foot portion 108 past the second position A and into the third position B.

The modified first forward stop 106 includes a first pivot stop 126 which includes a planar surface disposed at a predetermined angle. The modified first arm 104 includes a first pivot protrusion 128 which extends from the modified first arm 104 a predetermined distance and which includes a planar surface disposed thereon at a predetermined angle.

The first pivot protrusion 128 is adapted to contact the first pivot stop 126 in the third position B and to prevent any further pivotal motion of the modified first arm 104 from occurring in the direction of the arc 102.

A second pivot protrusion (not shown) is similarly attached to the second modified arm 124 and cooperates with a second pivot stop (not shown) that is, in turn, attached to a modified second forward stop (not shown) all of which are disposed, in general, on the opposite side of the modified foot receiving portion 108 as compared to the side where the modified first forward stop 106 is disposed.

The modified first forward stop 106 and the modified second forward stop cooperate with the first modified recess 116 and a second modified recess 130, respectively, to limit the pivotal motion of the modified first arm 104 and the modified second arm 124 in a direction opposite that of the arc 102.

A modified fin portion 132 is attached to the modified first arm 104 and the modified second arm 124 at a distal end of each as compared to the modified axis 122.

Accordingly, the pivotal motion of the modified fin portion 132 with respect to the modified foot portion 108 is limited in the direction of the arc 102 by the first pivot protrusion 128 making contact with the first pivot stop 126 and by the second pivot protrusion making contact with the second pivot stop, respectively.

The pivotal motion of the modified fin portion 132 with respect to the modified foot portion 108 is limited in the direction opposite that of the arc 102 by the modified first forward stop 106 making contact with the first modified recess 116 and by the modified second forward stop making contact with the second modified recess 130, respectively, which aligns the modified fin portion 132 in the first position. The modified fin portion 132 is held in the first position by cooperation of the nose protrusion 66 with the latch 38 mechanism.

Even though the ideal magnitude of the arc 102 is 225 degrees rotation, slightly less or more rotation will work for jumping into the water. At least approximately 220 degrees of rotation is required to reach the third position B. The third position B must not exceed 270 degrees, which is not desirable due to the resultant excessive contact between the modified fin portion 132 and the leg 114 whenever 270 degrees of rotation is exceeded.

The preferred third position B is prevented from rotating beyond 225 degrees which keeps the modified fin portion 132 from bearing against the back of the leg 114 of the user when he jumps into the water and slightly points his toes (not shown) downward into a more vertical position for making contact with the water.

In the preferred third position B, the modified fin portion 132 lightly touches the back of the leg 114 of the user when he points his toes downward. This is also the position of least wind resistance possible because the modified fin portion 132 is very nearly parallel with the leg 114 of the user. The downward attitude of the modified foot portion 108 makes for smoother entry into the water than would landing with the bottom surface of the modified foot portion 108 held parallel with the water surface.

The force of the wind upon the modified fin portion 132 urges the modified fin portion 132 to pivot in the direction of the arc 102 until the third position B is reached at which time the first pivot protrusion 128 contacts the first pivot stop 126 which prevents any further pivotal motion from occurring. Therefore, the modified fin 100 automatically tends to seek the third position B when the user jumps through the air and into the water below.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A pivotable swim fin, comprising:

(a) a foot receiving portion, said foot receiving portion including an enclosure adapted to receive at least a portion of a foot therein, said enclosure having, in general, a bottom, a pair of sides, a front, a top, and an opening disposed at a distal end of said enclosure with respect to said front, wherein said foot receiving portion includes at least one forward stop attached to at least one of said pair of sides;

(b) a fin portion including a first arm and a second arm disposed a predetermined distance apart from each other, said foot receiving portion disposed intermediate said first arm and said second arm, said first arm and said second arm being pivotally attached to said foot receiving portion wherein said first arm and said second arm are adapted to pivot about an axis with respect to said foot receiving portion in a first direction and in an opposite second direction;

(c) a recess provided in at least one of said first arm and said second arm, said recess adapted to cooperate with said at least one forward stop to limit the pivotal motion in said first direction;

(d) a web attached to said first arm and to said second arm; and (e) a spring biased latch mechanism attached to said swim fin, said spring biased latch mechanism securing said fin portion with respect to said foot receiving portion when said recess cooperates with said at least one forward stop to limit the pivotal motion in said first direction.

2. The pivotable swim fin of claim 1 wherein said at least one forward stop is integral with said foot receiving portion.

3. The pivotable swim fin of claim 1 wherein said first arm and said second arm is pivotally attached to said foot receiving portion at a first end of said first arm and at a first end of said second arm.

4. The pivotable swim fin of claim 3 wherein said first arm and said second arm each include an opposite end, said opposite end of each being attached to said web.

5. The pivotable swim fin of claim 4 wherein said opposite end of said first arm and said opposite end of said second arm extend on opposite sides of said web a substantial portion of the length of said web.

6. The pivotable swim fin of claim 4 including an inner reinforcing member disposed in said fin portion.

7. The pivotable swim fin of claim 1 wherein said foot receiving portion includes a nose protrusion attached to said front thereof, said nose protrusion including a lower portion disposed adjacent to said front and an upper portion that is disposed a predetermined distance from said front, a tapered surface disposed intermediate thereto, and a substantially planar area disposed intermediate said upper portion and said front.

8. The pivotable swim fin of claim 7 wherein said tapered surface is planar.

9. The pivotable swim fin of claim 7 wherein said tapered surface is arcuate.

10. The pivotable swim fin of claim 1 wherein said latch mechanism is disposed on said fin portion.

11. The pivotable swim fin of claim 1 wherein said latch mechanism includes a cylindrical portion.

12. The pivotable swim fin of claim 11 wherein said latch mechanism includes a tapered catch adapted to slide longitudinally within said cylindrical portion.

13. The pivotable swim fin of claim 12 wherein said tapered catch includes at least one groove disposed therein, said groove being disposed parallel with respect to a longitudinal axis of said cylindrical portion.

14. The pivotable swim fin of claim 11 wherein said latch mechanism includes at least one drain hole through said cylindrical portion.

15. The pivotable swim fin of claim 1 including means for limiting the pivotal motion in said second direction.

16. The pivotable swim fin of claim 15 wherein said means for limiting includes a protrusion attached to at least one of said first arm and said second arm that is adapted to contact a first pivot stop attached to said foot receiving portion.

17. The pivotable swim fin of claim 1 wherein said forward stop includes an extension that is adapted to receive a first end of a heel strap.

18. A pivotable swim fin, comprising:

(a) a foot receiving portion, said foot receiving portion including an enclosure having a front, a bottom, and two sides, said foot receiving portion being adapted to receive at least a portion of a foot therein, and having a nose protrusion attached to said front thereof, said nose protrusion including a lower portion disposed adjacent to said front and an upper portion that is disposed a predetermined distance from said front, a tapered surface disposed intermediate thereto, and a substantially planar area disposed intermediate said upper portion and said front;

(b) a fin portion including a web, said fin portion adapted to pivot about an axis with respect to said foot receiving portion from a first position adapted for swimming into a second position adapted for walking; and (c) a latch mechanism attached to said fin portion adapted to cooperate with said nose protrusion, said latch mechanism including a base and a cylindrical portion attached to said base, said cylindrical portion including at least one drain hole therein.

19. The pivotable swim fin of claim 18 wherein said cylindrical portion includes a first cylinder end proximate said foot receiving portion, said first cylinder end including an opening therein and a second cylinder end disposed distally with respect to said first cylinder end and including a tapered catch disposed substantially in said cylindrical portion that is adapted to slide longitudinally within said cylindrical portion between a first catch position wherein said tapered catch is maximally extended from said first cylinder end and a second catch position wherein said tapered catch is maximally retracted into said cylindrical portion.

20. The pivotable swim fin of claim 19 wherein said tapered catch includes at least one groove disposed therein, said groove being disposed parallel with respect to a longitudinal axis of said cylindrical portion.

21. The pivotable swim fin of claim 19 including means for retaining said tapered catch into said cylindrical portion.

22. The pivotable swim fin of claim 21 including a spring disposed in said cylindrical portion intermediate said tapered catch and said second cylinder end wherein said spring supplies a force which urges said tapered catch toward said first catch position.

23. The pivotable swim fin of claim 21 wherein said means for retaining includes at least one slot formed in said cylindrical portion, said at least one slot including a lesser width and a greater length, said greater length being disposed parallel with respect to a longitudinal axis of said cylindrical portion and including at least one pin, said at least one pin passing through said at least one slot and attached to said tapered catch.

24. The pivotable swim fin of claim 19 wherein said tapered catch includes an arcuate end and an opposite flat end, said flat end being disposed adjacent to said planar area of said nose protrusion when said tapered catch is in said first catch position.

25. The pivotable swim fin of claim 19 including means for urging said tapered catch from said first catch position into said second catch position.

26. The pivotable swim fin of claim 25 wherein said means for urging includes means attached to said tapered catch.

27. The pivotable swim fin of claim 18 wherein said latch mechanism is attached to said fin portion by at least one fastener passing through said base.

28. The pivotable swim fin of claim 18 wherein said fin portion includes a recess area adapted to retain said latch mechanism.

29. The pivotable swim fin of claim 28 wherein said recess includes a pair of oppositely tapered sides disposed in said web that are disposed further apart with respect to each other at the top of said recess and closer together with respect to each other at the bottom of said recess, and including an indented portion disposed at the bottom of said recess, said indented portion adapted for retaining said base.

30. The pivotable swim fin of claim 28 wherein said recess is adapted to form an enclosure about at least a portion of said latch mechanism.

31. The pivotable swim fin of claim 18 including a pair of outer sides that are substantially in planar alignment with respect to each other and which are each disposed on opposite sides of said fin portion and which extend above said web a sufficient amount to prevent said cylindrical portion from making substantial contact with a surface of the ground when said fin portion is pivoted into said second position.

32. The pivotable swim fin of claim 18 including a heel strap attached to said foot receiving portion.

33. The pivotable swim fin of claim 18 wherein said fin portion is adapted to pivot about said axis into a third position adapted for free falling through the air.

34. The pivotable swim fin of claim 33 wherein said third position is approximately 225 degrees of rotation for said fin portion from said first position with respect to said foot receiving portion.

35. The pivotable swim fin of claim 33 wherein said third position includes a minimum range of pivotal motion for said fin portion that is greater than 220 degrees from said first position and a maximum range of pivotal motion for said fin portion that is less than 270 degrees from said first position, each of said minimum and maximum ranges being measured with respect to said foot receiving portion.

36. The pivotable swim fin of claim 33 including means for limiting said fin portion from pivoting beyond said third position.

37. The pivotable swim fin of claim 36 wherein said means for limiting includes a protrusion attached to said fin portion that is adapted to contact an abutment attached to said foot receiving portion.

* * * * *